US009474664B2

(12) United States Patent
Mulhern et al.

(10) Patent No.: US 9,474,664 B2
(45) Date of Patent: Oct. 25, 2016

(54) ANTI-TIP AND SUSPENSION SYSTEMS FOR WHEELCHAIRS

(75) Inventors: James P. Mulhern, Nanticoke, PA (US); Christopher Grymko, Laflin, PA (US)

(73) Assignee: Pride Mobility Products Corporation, Exeter, PA (US)

( * ) Notice: Subject to any disclaimer, the term of this patent is extended or adjusted under 35 U.S.C. 154(b) by 0 days.

(21) Appl. No.: 13/877,374

(22) PCT Filed: Oct. 4, 2011

(86) PCT No.: PCT/US2011/054702

§ 371 (c)(1),
(2), (4) Date: May 14, 2013

(87) PCT Pub. No.: WO2012/047844

PCT Pub. Date: Apr. 12, 2012

(65) Prior Publication Data

US 2013/0306383 A1 Nov. 21, 2013

Related U.S. Application Data

(60) Provisional application No. 61/389,946, filed on Oct. 5, 2010.

(51) Int. Cl.

| | |
|---|---|
| ***A61G 5/04*** | (2013.01) |
| *A61G 5/06* | (2006.01) |
| *A61G 5/10* | (2006.01) |

(52) U.S. Cl.

CPC ..... *A61G 5/04* (2013.01); *A61G 5/045* (2013.01); *A61G 5/063* (2013.01); *A61G 2005/1078* (2013.01); *A61G 2005/1089* (2013.01)

(58) Field of Classification Search

USPC ..... 180/65.1, 6.48, 6.5, 209, 907; 280/304.1, 293, 767, 250.1; 297/423.26, 423.34, 423.36, DIG. 4

IPC ..... A61G 5/045,2005/1089, 2005/1078, A61G 5/063, 5/04

See application file for complete search history.

(56) References Cited

U.S. PATENT DOCUMENTS

| | | | |
|---|---|---|---|
| 6,047,979 | A | 4/2000 | Kraft et al. |
| 6,357,793 | B1 | 3/2002 | Dickie et al. |

(Continued)

FOREIGN PATENT DOCUMENTS

| | | | |
|---|---|---|---|
| WO | WO00/12040 | A1 | 3/2000 |
| WO | WO00/69385 | A1 | 11/2000 |
| WO | WO 2004/037569 | A2 | 5/2004 |

*Primary Examiner* — Faye M Fleming
(74) *Attorney, Agent, or Firm* — Baker & Hostetler LLP

(57) ABSTRACT

A wheelchair according to one embodiment includes a frame, a pair of drive wheels operatively coupled to the frame, a drive operatively coupled to each drive wheel, and a pair of anti-tip assemblies. Each anti-tip assembly includes a first member, a second member pivotally coupled to the first member at a joint that defines a pivot axis, an anti-tip wheel rotatably coupled to the second member, and a locking mechanism. The second member is capable of pivoting about the pivot axis between an extended position and a collapsed position. The locking mechanism is configured to selectively lock the second member in the extended position.

23 Claims, 12 Drawing Sheets

(56) References Cited

U.S. PATENT DOCUMENTS

| | | | | |
|---|---|---|---|---|
| 6,851,711 | B2 * | 2/2005 | Goertzen | A61G 5/043 280/124.104 |
| 6,880,661 | B1 | 4/2005 | Oh | |
| 6,923,278 | B2 * | 8/2005 | Mulhern et al. | 180/65.1 |
| 7,694,990 | B2 * | 4/2010 | Goertzen et al. | 280/304.1 |
| 8,585,071 | B2 * | 11/2013 | Golden, Jr. | 280/304.1 |
| 2003/0197345 | A1 | 10/2003 | Nelson | |
| 2003/0205420 | A1 | 11/2003 | Mulhern et al. | |
| 2006/0244249 | A1 | 11/2006 | Goertzen et al. | |
| 2012/0169025 | A1 * | 7/2012 | Golden, Jr. | 280/250.1 |

* cited by examiner

ANTI-TIP AND SUSPENSION SYSTEMS FOR WHEELCHAIRS

CROSS REFERENCE TO RELATED APPLICATIONS

This application is the National Stage of International Application No. PCT/US2011/054702, filed Oct. 4, 2011, which claims the benefit of U.S. Provisional Application No. 61/389,946 filed Oct. 5, 2010 the disclosures of which are incorporated herein by reference in their entireties.

BACKGROUND

Some members of society have difficulty walking due to health problems. To provide mobility to these people, power wheelchairs have been developed. Powered wheelchairs often have six wheels including a pair of center wheels, a pair of rear wheels, and a pair of front wheels. Typically, one pair of wheels is driven by, and directly connected to, a drive. The drive wheels are typically fixed to the wheelchair and not capable of being repositioned to accommodate different sized occupants.

In cases where the wheelchair is a rear-wheel drive wheelchair the front wheels are configured to ride on the ground surface during normal operation and provide stability to the wheelchair during such operation. Typically, these front wheels have the capability to swivel about a vertical axis and are referred to as "casters." When the wheelchair is driving in a forward direction the front wheels are configured to overcome an obstacle such as a curb. Therefore, these front wheels are connected to a suspension that allows them to rotate about a pivot as the wheelchair is overcoming the obstacle. In some cases the suspensions may cause the front wheels to at first rotate counterclockwise into the obstacle which may be undesirable. Additionally, certain suspensions do not maintain the swivel axis of the casters in a substantially vertical orientation, which may cause the front casters to catch while the wheelchair is turning.

The rear wheels, on the other hand, are fixed and often times referred to as anti-tip wheels. The anti-tip wheels may be suspended above the ground plane on which the wheelchair rests. The suspension of the anti-tip wheels allows the wheelchair to clear small obstacles such as a curb that may be in the path of travel of the wheelchair. In this case, where the wheelchair is a rear-wheel drive wheelchair, the anti-tip wheels may inhibit the wheelchair from overcoming the obstacle as the wheelchair is backing over the obstacle. Therefore, it may be desirable to provide a wheelchair with an anti-tip system that overcomes this problem.

SUMMARY

A wheelchair according to one embodiment includes a frame, a pair of drive wheels operatively coupled to the frame, a drive operatively coupled to each drive wheel, and a pair of anti-tip assemblies. Each anti-tip assembly includes a first member, a second member pivotally coupled to the first member at a joint that defines a pivot axis, an anti-tip wheel rotatably coupled to the second member, and a locking mechanism. The second member is capable of pivoting about the pivot axis between an extended position and a collapsed position. The locking mechanism is configured to selectively lock the second member in the extended position.

In another embodiment, a wheelchair includes a frame, a pair of drive wheels operatively coupled to the frame, and a drive operatively coupled to each drive wheel to thereby define respective drive-wheel assemblies. The wheelchair further includes an anti-tip assembly operatively attached to each drive wheel assembly. Each anti-tip assembly includes an anti-tip wheel. Each anti-tip assembly is configured to have an extended position, and a collapsed configuration in which the anti-tip wheel is positioned substantially within a circumference of the drive wheel.

DETAILED DESCRIPTION OF THE DRAWINGS

The foregoing summary, as well as the following detailed description of a preferred embodiment of the application, will be better understood when read in conjunction with the appended drawings. For the purposes of illustrating the wheelchair and systems of the present application, there is shown in the drawings preferred embodiments. It should be understood, however, that the application is not limited to the precise arrangements and systems shown. In the drawings.

DETAILED DESCRIPTION OF ILLUSTRATIVE EMBODIMENTS

Figure 1A:
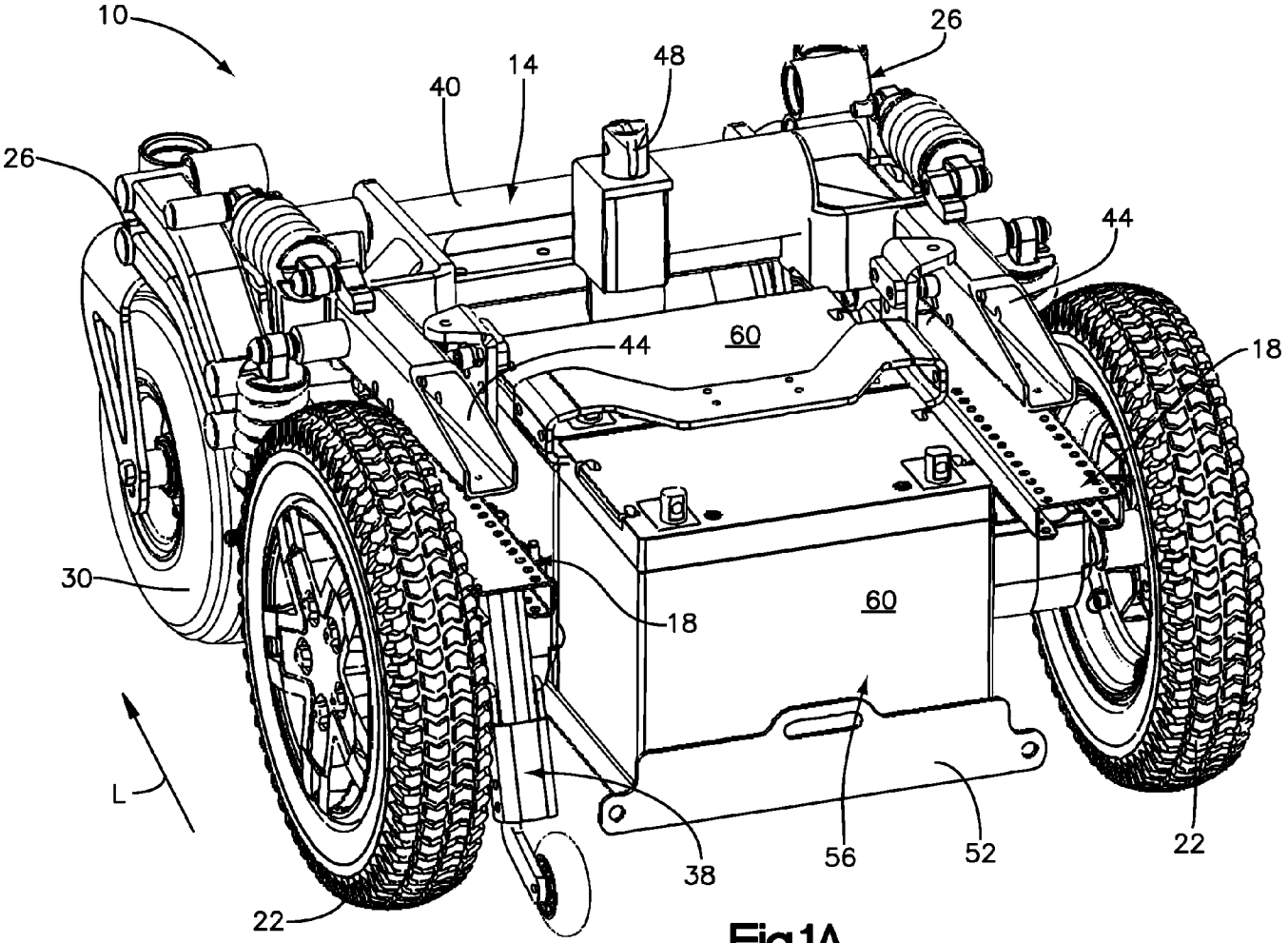
FIG. 1A is a rear perspective view of a wheelchair in accordance with one embodiment, the wheelchair including an improved suspension system and a rear anti-tip system.
Figure 1B:
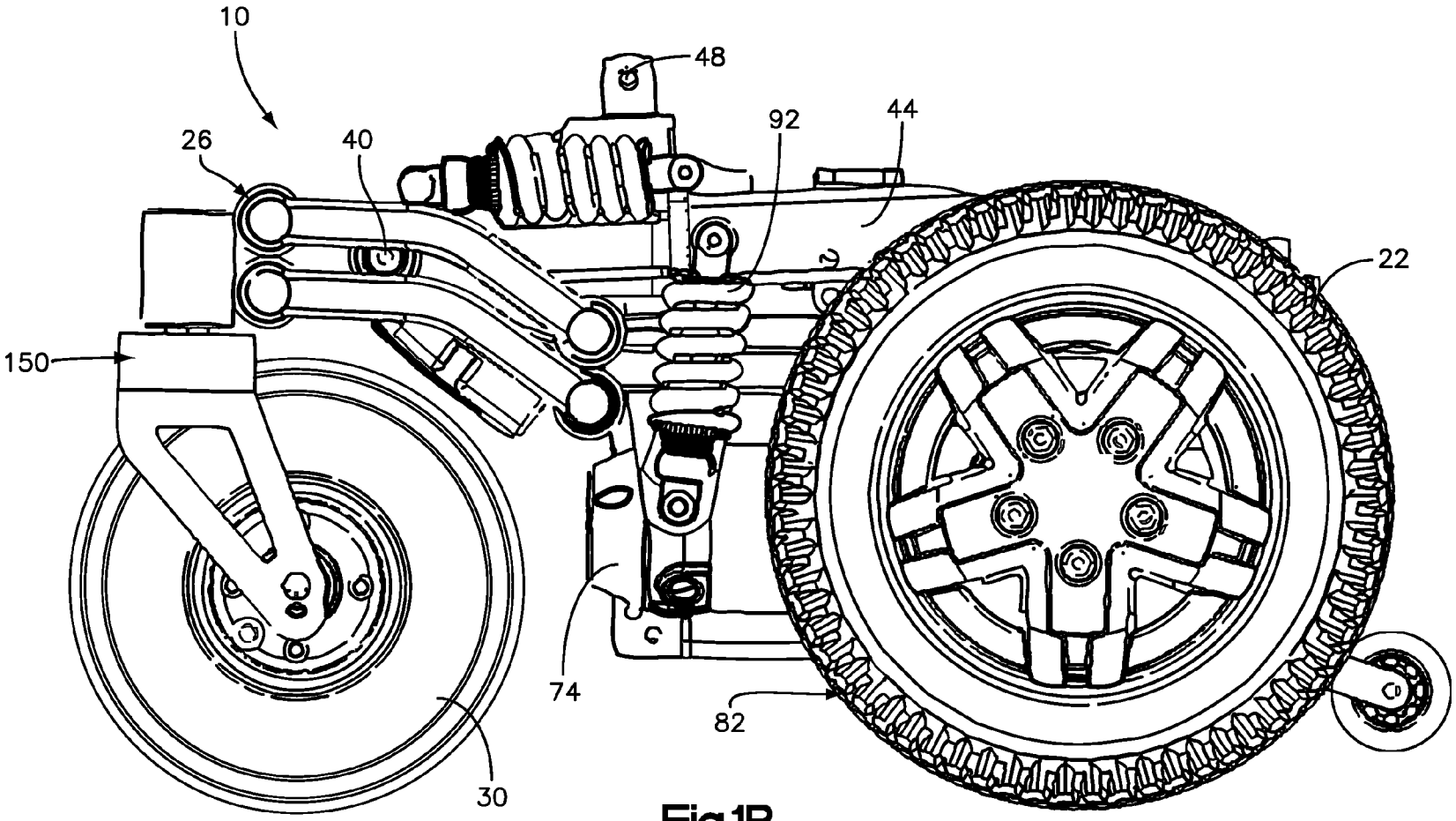
FIG. 1B is a side elevation view of the wheelchair shown in FIG. 1A.
Figure 1C:
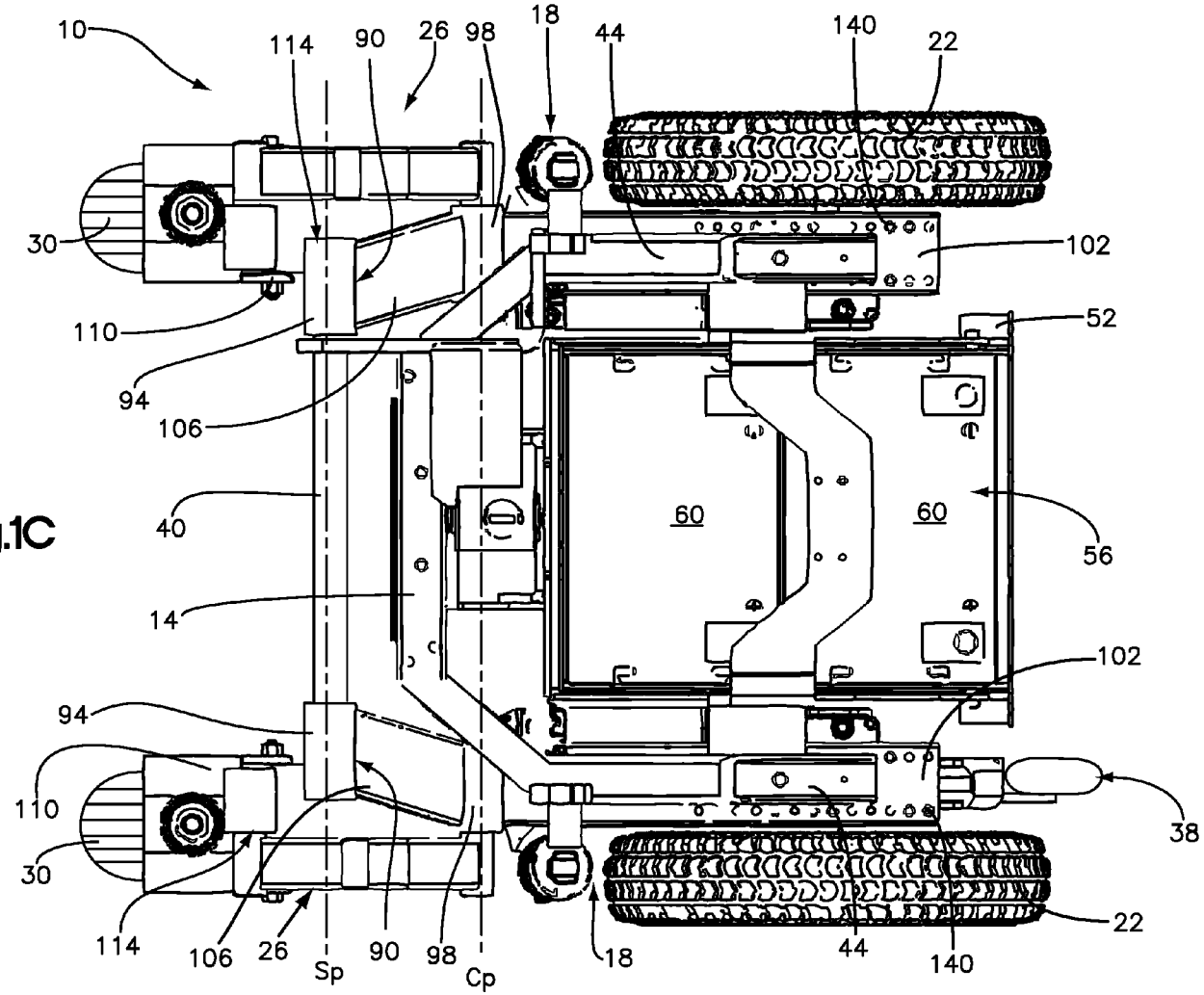
FIG. 1C is a top plan view of the wheelchair shown in FIG. 1A.

Referring to FIGS. 1A-1C, a powered wheelchair 10 is disclosed. In the illustrated embodiment, the wheelchair 10 is a rear-wheel drive powered wheelchair. Here, rear-wheel drive means that the main drive wheels are nominally in the rear of the wheelchair. The wheelchair 10 is configured to move in a forward direction along a longitudinal direction L. It should be understood, however, that the present invention is not limited to rear-wheel drive wheelchairs unless specifically recited in the claims, and this definition is merely for clarity of description of the illustrated embodiment.

As shown in FIGS. 1A-1C, the wheelchair 10 includes a frame 14, a pair of drive-wheel suspension assemblies 18 that operatively couple respective drive wheels 22 to the frame 14, and a pair of front-wheel suspension assemblies 26 that operatively couple respective front wheels 30 to the frame 14. The drive-wheel suspension assemblies 18 and the front-wheel suspension assemblies 26 are each coupled to respective lateral sides of the frame 14. As shown, the wheelchair 10 further includes a pair of anti-tip assemblies 38 that are operatively coupled to the frame 14 rearward to the drive wheels 30. The anti-tip assemblies 38 are configured to prevent the wheelchair 10 from tipping backwards.

The frame 14 is a box-like structure that is formed of welded and/or bolted square and round tubing and formed plates. The frame 14 includes a forward transverse shaft 40, a pair of longitudinally elongate members 44 that are coupled to and extend rearward from opposed end portions of the transverse shaft 40, and a seat post 48 that is rearward to the transverse shaft 40. The transverse shaft 40 is generally a cylindrical bar and is elongate in a direction that is transverse to the longitudinal direction L. As shown in FIG. 1C, the transverse shaft 40 defines a front end of the frame 14. Also shown in FIG. 1C, the members 44 are rigidly connected to the transverse shaft 40 and extend rearward such that each member 44 at least partially defines a respective lateral side of the frame 14.

As shown in FIG. 1A, the seat post 48 extends vertically, and protrudes from the frame 14 rearward to the transverse shaft 40. The seat post 48 is configured to support a wheelchair seat that is capable of supporting an infirmed occupant. Typical wheelchair seats include a seat support, a back support that extends up from the seat support, and opposed arm rests that extend forward from the back support.

As shown in FIGS. 1A and 1C, the frame 14 further includes a battery compartment 52 that is configured to support and retain a power supply 56. As shown, the battery compartment 52 is generally disposed between the opposed members 44 and rearward to the seat post 48. In the illustrated embodiment, the power supply 56 is a set of batteries 60 that rest within the battery compartment 52 and are accessible from the rear side of the frame 14. The batteries 60 are configured to supply power to the wheelchair 10.

Figure 2A:
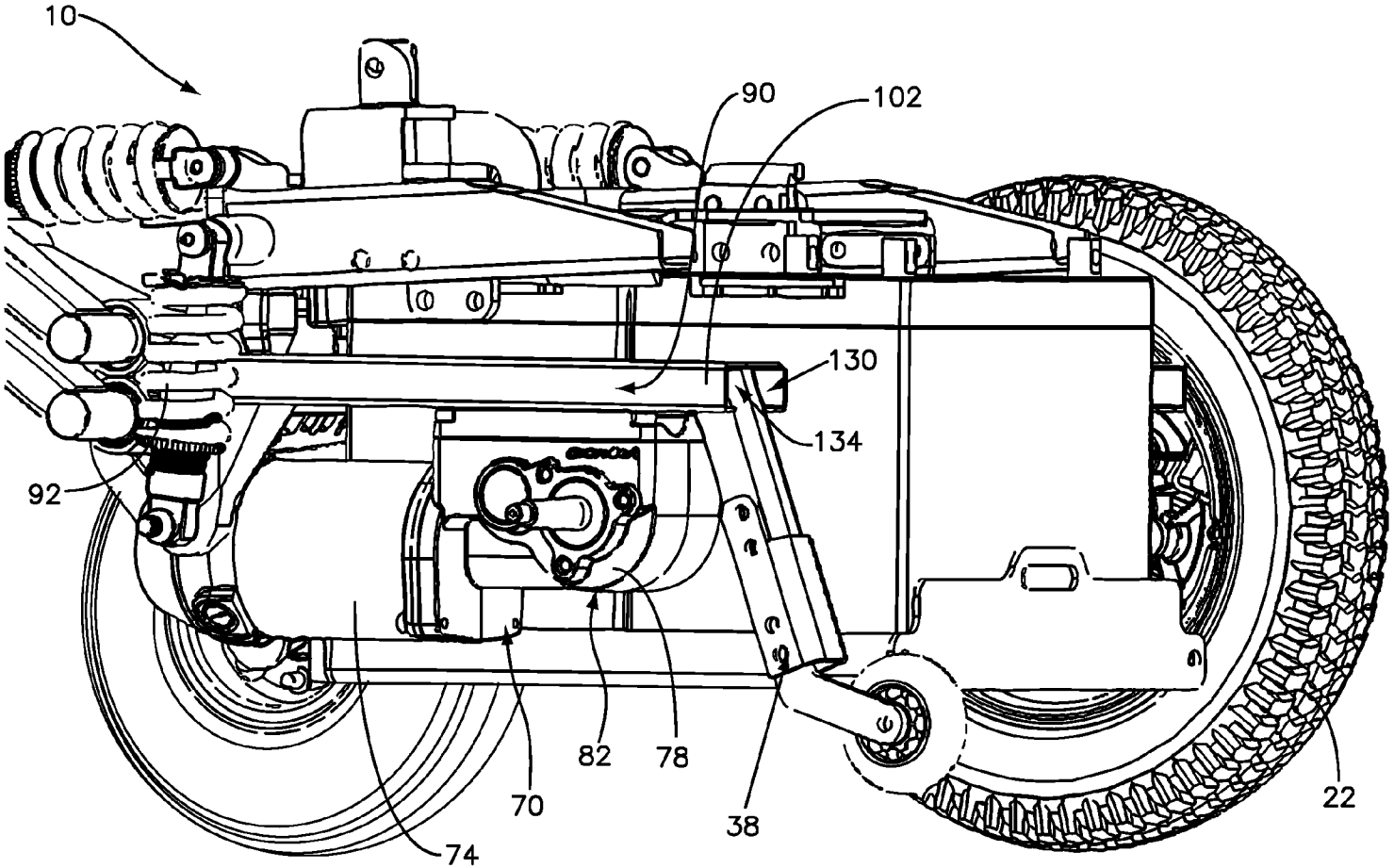
FIG. 2A is a side perspective view of the wheelchair shown in FIG. 1A, with a drive wheel removed for clarity.
Figure 2B:
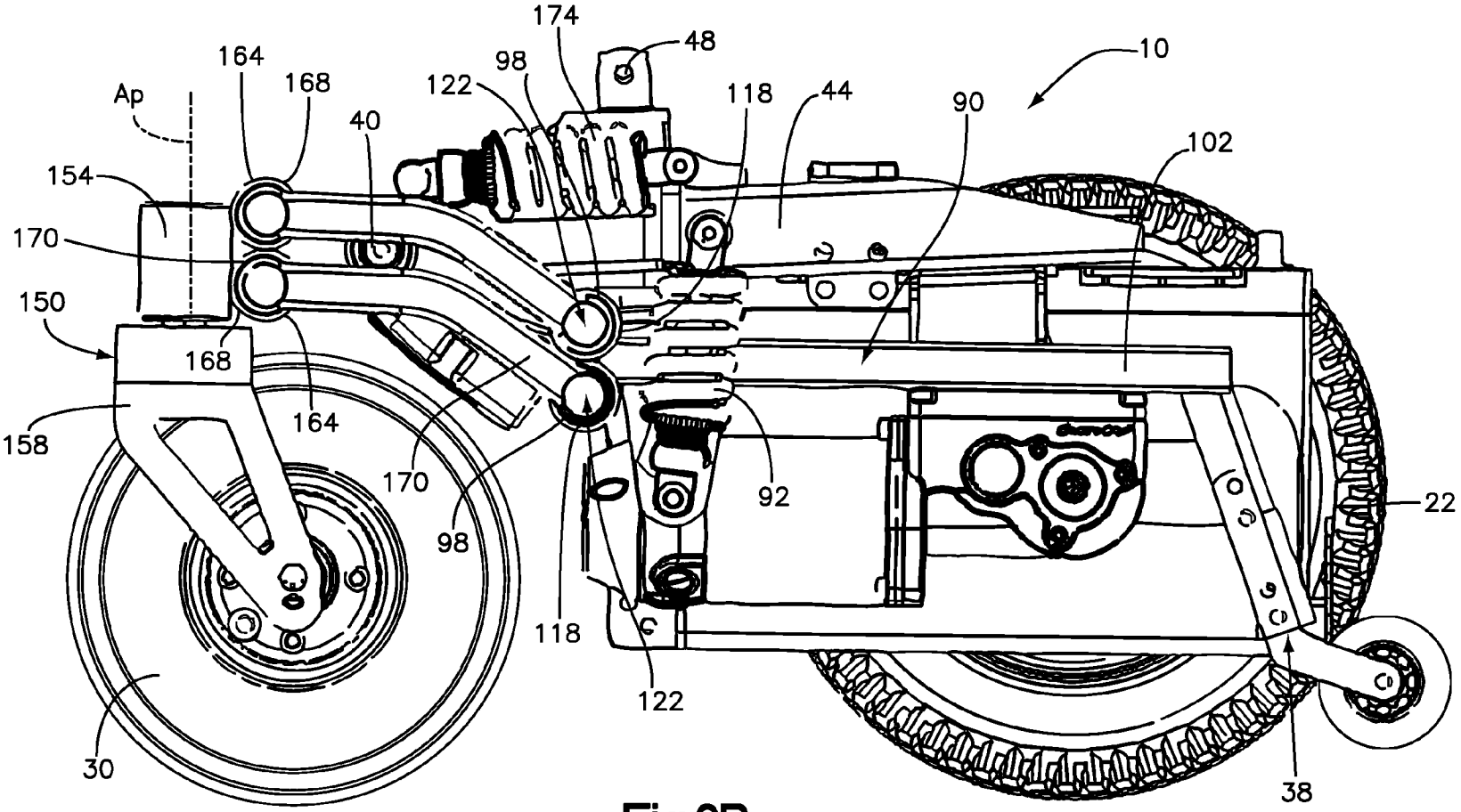
FIG. 2B is a side elevation view of the wheelchair shown in FIG. 2A.

As shown in FIGS. 1B and 2A-2B, the wheelchair 10 further includes a pair of drive assemblies 70 each coupled to a respective drive wheel 22. Each drive assembly 70 includes a motor 74 and a gear box 78. Each drive assembly 70 is configured to drive its respective drive wheel 22 upon activation by the occupant. As shown in FIGS. 2A and 2B, each motor 74 is mounted in the longitudinal direction such that the motor 74 extends forward from the drive wheel 22. The drive assemblies 70 including the motors 74 and the gear boxes 78 are each translatably coupled to respective drive-wheel suspension assemblies 18. In this way, each drive assembly 70 and corresponding drive wheel 22 together define a respective drive wheel assembly 82 that is translatably coupled to a respective drive-wheel suspension assembly 18. To translatably couple each drive wheel assembly 82 to a respective drive-wheel suspension assembly 18 each drive wheel assembly 82 includes a mounting member.

As shown in FIGS. 1C and 2A-2B, each drive-wheel suspension assembly 18 is configured to operatively attach each drive wheel assembly 82 to the frame 14. As shown, each drive-wheel suspension assembly 18 includes a swing arm 90 that is rotatably coupled to the transverse shaft 40 and a spring 92. Generally, the swing arms 90 are rotatably coupled to the end portions of the shaft 40 laterally outside of the members 44. Generally, the drive wheel suspension assembly 18 will be described in reference to the left side of the wheelchair 10 as shown in FIGS. 2A and 2B. It should be understood, however, that the drive wheel suspension assembly 18 for the right side of the wheelchair 10 is generally the same as the drive wheel suspension assembly 18 for the left side of the wheelchair 10.

As best shown in FIGS. 1C and 2A-2B, each swing arm 90 includes a forward swing arm pivot 94, a pair of caster arm pivots 98, and a motor mounting portion 102 that extends rearward from the caster arm pivot 98. Each swing arm 90 also includes a linkage 106 that extends from the swing arm pivot 94 to the caster arm pivots 98. As shown in FIG. 2B, the linkage 106 extends rearward from the swing arm pivot 94 and down at an angle to the caster arm pivots 98. Therefore, the caster arm pivots 98 are rearward to and vertically lower than the swing arm pivot 94.

As best shown in FIG. 1C, each swing arm pivot 94 is a barrel 110 that defines a horizontal and laterally extending bore 114. The bore 114 is configured to receive and house the shaft 40 such that the swing arm 90 is capable of rotating about the shaft 90. In this way, the shaft 90 defines a horizontal swing arm pivot axis $S_P$.

Similarly and in reference to FIG. 2B, each caster arm pivot 98 is a barrel 118 that defines a horizontal and laterally extending bore 122. As shown in FIG. 2B, the barrels 118 are generally vertically aligned one on top of the other. Each of the bores 122 of the barrels 118 is configured to receive and house a portion of a respective caster arm such that the caster arms are capable of rotating about the barrels 118. In this way, the barrels 118 define horizontal caster arm pivot axes $C_P$ As shown in FIGS. 1C and 2B, both caster arm pivot axes $C_P$ are rearward to and vertically lower than the swing arm pivot axis Sp.

As shown in FIGS. 1C and 2A-2B, each motor mounting portion 102 of the swing arms 90 extends rearward from the caster arm pivots 98 and terminates proximate to a rear end of the frame 14. As shown in FIG. 2A, the motor mounting portions 102 each define a channel 130 that extends along a substantial portion of the motor mounting portion 102. As shown, the channels 130 are rectangular in shape and include a bottom opening 134 that extends along the length of the channel 130. Each channel 130 is configured to receive the mounting member of a respective drive wheel assembly 82 such that the mounting member extends through the channel opening 134 and the drive assembly 70 is suspended below the swing arm 90. The entire drive wheel assembly 82 is capable of translating forward and backward within the channel 130. This allows the drive wheels 22 to be placed at different locations along the drive wheel suspension assembly 18. Therefore the drive wheel suspension for the wheelchair 10 can be customized to the particular occupant of the wheelchair 10. For example, it may be desired to move the drive wheels 22 either forward toward the front of the wheelchair or rearward toward the back of the wheelchair depending on the weight of the wheelchair occupant. In the illustrated embodiment, the drive wheels 22 and in particular the drive wheel assemblies 82 may be moved along the swing arm 90 of the drive wheel suspension assembly 18 a distance of at least 3 inches.

As shown in FIG. 1C, the motor mounting portion 102 of each swing arm 90 includes a plurality of holes 140 that extend through a top surface of the mounting portion 102 and into the channel 130. As shown, the holes 140 extend along a substantial portion of the mounting portion 102. The holes 140 are configured to receive fixation members that lock the drive wheel assembly 82 in place once the drive wheel assembly 82 has been properly positioned along the swing arm 90.

As shown in FIG. 2B, the drive-wheel suspension assemblies 18 each further include a spring 92 that is configured to dampen vibrations or shock experienced by the wheelchair 10. As shown, the spring 92 of each drive-wheel suspension assembly 18 extends in a substantially vertical direction, and is coupled to both the frame 14 and to a respective drive wheel assembly 82. In particular, an upper end of each spring 92 is coupled to a respective member 44 of the frame 14 and a lower end of each spring 92 is coupled to a respective motor 74. The springs 92 are configured to absorb shock as the wheelchair 10 moves over uneven terrain.

Referring now to the front wheels 30 of the wheelchair 10 and as shown in FIG. 2B, each front wheel 30 is part of a caster assembly 150. As shown, the caster assemblies 150 each include a vertical caster barrel 154 and a wheel support 158 that is rotatably coupled to the caster barrel 154. As shown, each caster barrel 154 is substantially vertically oriented and includes a bore that is configured to receive a portion of the wheel support such that the wheel supports 158 are capable of rotating about their respective caster barrel 154. In this way, the caster barrels 154 each define a vertical caster axis $A_P$. As shown in FIG. 2B, the wheel supports 158 extend down from the caster barrels 154 and are coupled to respective front wheels 30 such that the front wheels 30 are capable of rotating within the wheel supports 158 along a horizontal axis. Because the front wheels 30 are operatively coupled to the caster barrels 154, the front wheels 30 may swivel as the wheelchair 10 is turned.

As shown in FIGS. 1C and 2B, each caster assembly 150 further includes a pair of horizontal pivots 164 that are coupled to the caster barrels 154. As shown, the horizontal pivots 164 are barrels 168 that are vertically aligned one on top of the other. Each barrel 168 defines a horizontal laterally extending bore that defines a pivot axis that is parallel to the caster arm pivot axes $C_p$ that are defined by the barrels 118 of the swing arms 90.

As shown in FIGS. 1C and 2B, the front-wheel suspension assemblies 26 operatively couple the caster assemblies 150 and in particular the front wheels 30 to the frame 14. As shown, each front-wheel suspension assembly 26 includes a pair of caster arms 170, and a spring 174. Each caster arm 170 is a linkage that is rotatably coupled to a respective caster assembly barrel 168 at a front end and a respective swing arm barrel 118 at a back end. As best shown in FIG. 2B, an upper caster arm 170 extends from an upper caster assembly barrel 168 to an upper swing arm barrel 118. Similarly, a lower caster arm 170 extends from a lower caster assembly barrel 168 to a lower swing arm barrel 118. Each caster arm 170 initially extends rearward and then down at an angle toward the swing arm barrel 118.

Each caster arm 170 includes horizontally extending shafts that extend laterally from opposed ends of the caster arms 170. The shafts are configured to engage the bores defined by the caster assembly barrels 168 and the swing arm barrels 118. Therefore, as the caster assemblies 150 are rotated vertically or otherwise in a clockwise direction, the shafts of the caster arms 170 may rotate within the barrels 118 and 168.

As shown in FIG. 2B, each front-wheel suspension assembly 26 further includes a spring 174 that is configured to dampen vibrations or shock experienced by the wheelchair 10. As shown, each spring 174 of a respective front-wheel suspension assembly 26 extends in a substantially horizontal direction, and is coupled to the frame 14 and to a respective upper caster arm 170. In particular, a rearward end of each spring 174 is coupled to a respective member 44 of the frame 14 and a forward end of each spring 174 is coupled to a respective upper caster arm 170. The springs 174 are configured to absorb shock as the wheelchair 10 moves over uneven terrain.

Because of the configuration of the front-wheel suspension assemblies 26, the wheelchair 10 may traverse obstacles more easily in a forward direction. For example, by having two caster arms 170 for each assembly 26 that are rotatably coupled to both the caster assembly 150 and to the swing arm 90, the caster arms 170 may be shorter in length while maintaining a high pivot for the assembly 26. The shorter arms allow for a more cost effective wheelchair. The high pivots allow for all of the forces to go into forcing the assemblies 26, and thus the front wheels 30, up (i.e. clockwise) to thereby allow the wheelchair 10 to more easily traverse an obstacle as the wheelchair 10 moves in a forward direction.

Furthermore, the configuration of the front-wheel suspension assemblies 26 help maintain the vertical caster barrels 154 in a substantially vertical orientation. By maintaining the vertical orientation, the front wheels 30 will be able to swivel about the caster barrels 154 more easily and not get jammed or otherwise impeded during turning of the wheelchair 10.

Figure 3A:
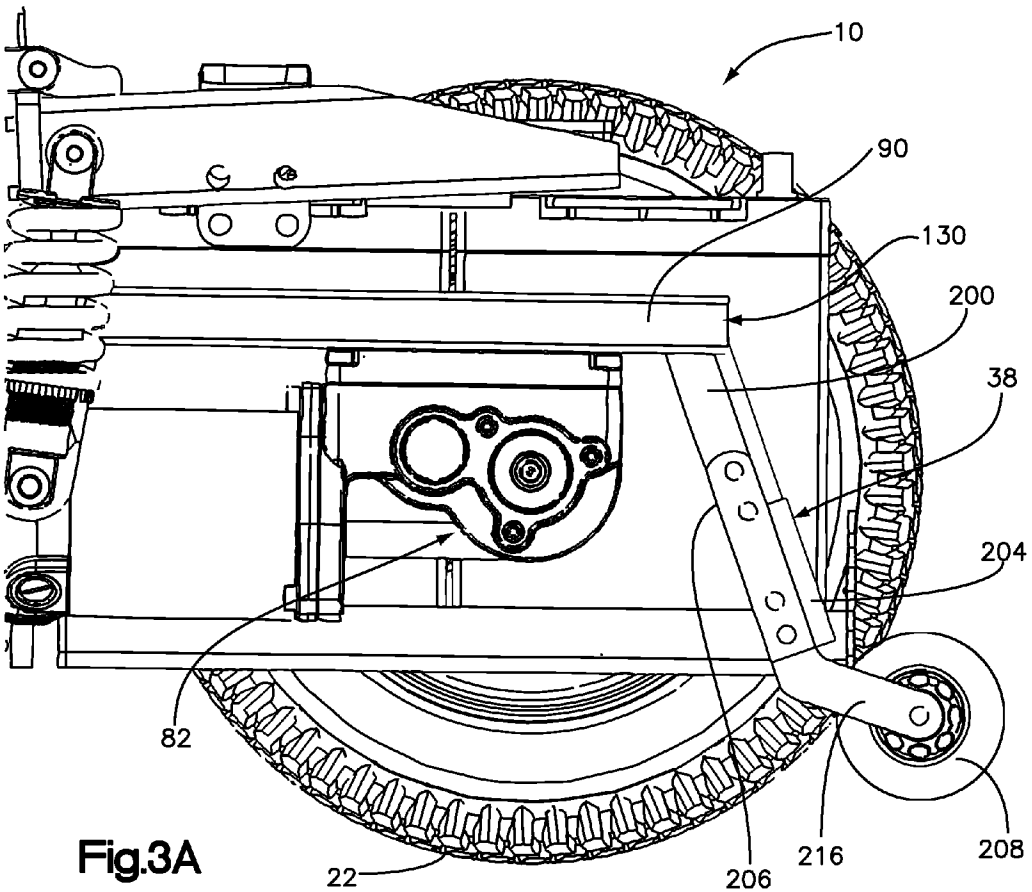
FIG. 3A is a detailed side elevation view showing the rear anti-tip system of the wheelchair shown in FIG. 1A in an extended position.
Figure 3B:
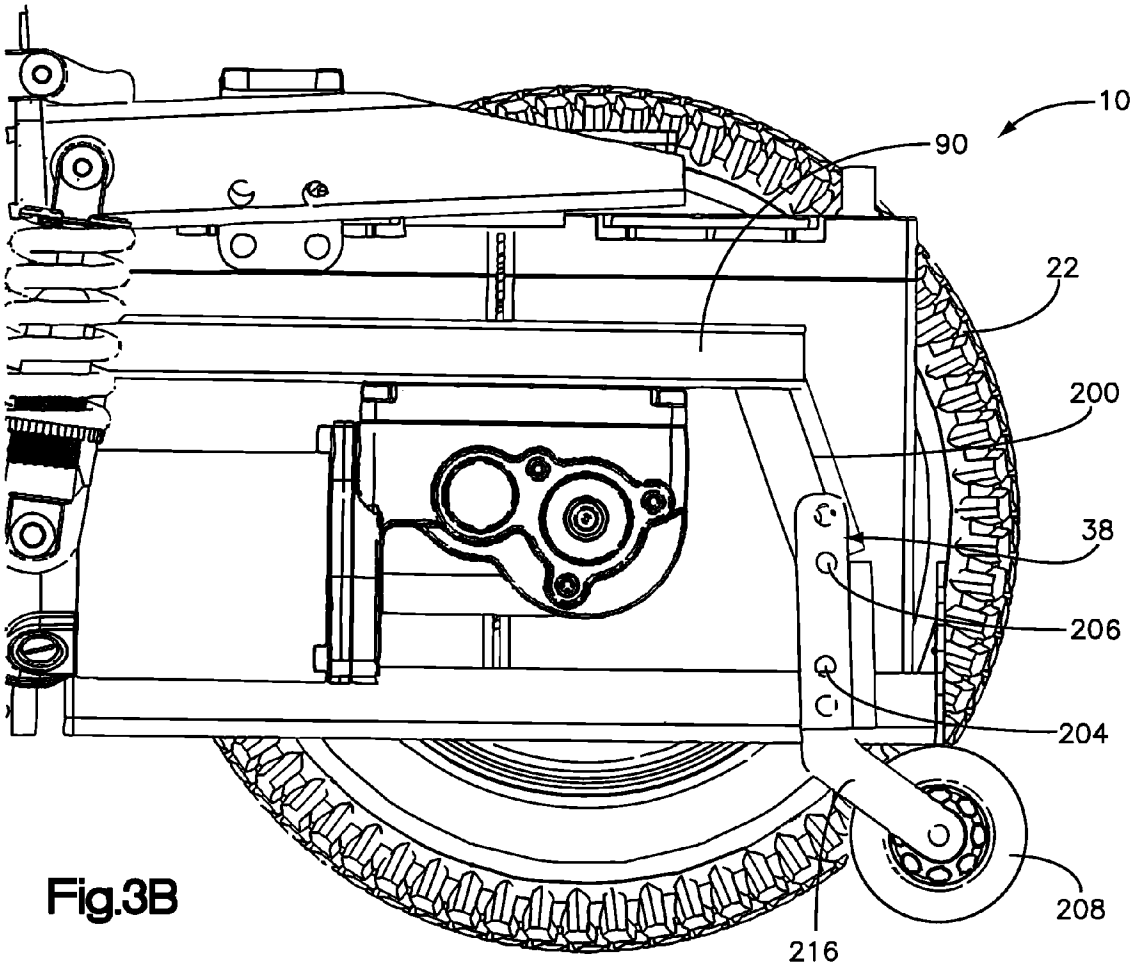
FIG. 3B is a detailed side elevation view of the anti-tip system shown in FIG. 3A, in a partially collapsed position.
Figure 3C:
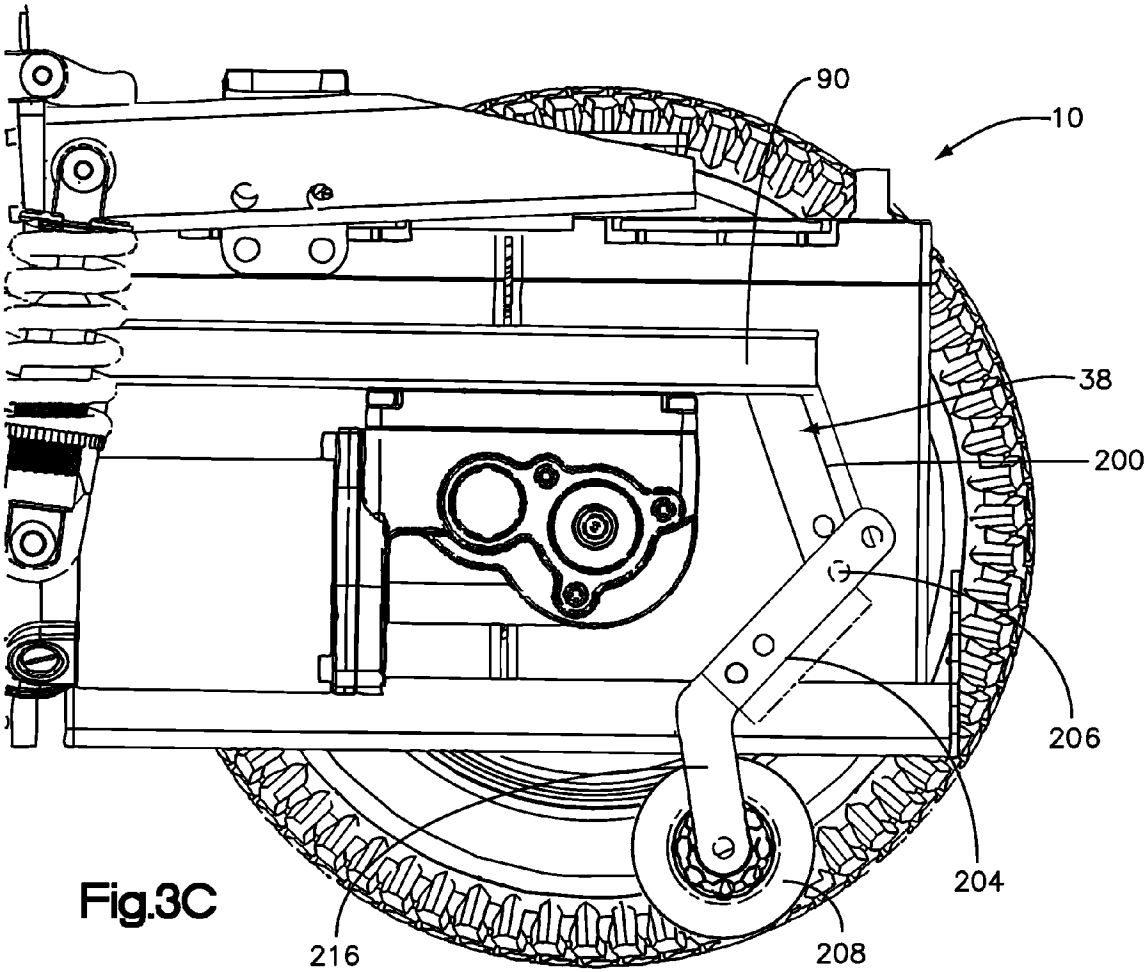
FIG. 3C is a detailed side elevation view of the anti-tip system shown in FIG. 3B, in a fully collapsed position.

Referring now to FIGS. 3A-3C, the wheelchair 10 further includes a pair of anti-tip assemblies 38 that are attached to the drive wheel assemblies 82 and thus operatively attached to the frame 14. While the anti-tip assemblies 38 are attached to the drive wheel assemblies 82, it should be understood that the anti-tip assemblies 38 may be directly attached to the frame 14, as desired. In the illustrated embodiment, because the anti-tip assemblies are attached to the drive wheel assemblies 82, as the drive wheel assemblies 82 are moved along the swing arm 90, the anti-tip assemblies 38 will move as well. As shown, each anti-tip assembly 38 includes a first member 200, a second member 204 pivotally coupled to the first member 200 at a joint 206 that defines a pivot axis, and an anti-tip wheel 208 that is rotatably coupled to the second member 204. The anti-tip assemblies 38 are configured to or are otherwise capable of pivoting between an extended position as shown in FIG. 3A and a collapsed position as shown in FIG. 3C.

As shown, each first member 200 extends into a channel 130 of a respective swing arm 90 and is coupled to the drive wheel assembly 82 at a first end. In particular the first member 200 extends down at an angle from the channel 130 and toward a rear end of the wheelchair 10. An opposed end of the first member 200 defines at least part of the joint 206. The second members 204 are pivotally coupled to the first members 200 at the joints 206 such that the second members 204 may pivot clockwise about the pivot axes defined by the joints 206, as shown in FIGS. 3B-3C.

As shown in FIG. 3A, an end of each second member 204 defines a foot 216 that extends rearward. The anti-tip wheels 208 are rotatably coupled to the ends of the feet 216. As shown in FIG. 3A, the anti-tip wheels 208 are positioned at least partially exterior to the circumference of the drive wheels 22 when the anti-tip assemblies 38 are in an extended position. Additionally, the anti-tip wheels 208 are positioned such that they are elevated from the ground when the anti-tip assemblies 38 are in the fully extended position. Therefore, if the wheelchair were to hit an obstacle as it is moving in a rearward direction such that the wheelchair 10 is caused to pivot or otherwise tip backwards, the extended anti-tip assemblies 38 or at least the anti-tip wheels 208 will contact the ground and prevent the wheelchair 10 from fully tipping.

If the wheelchair were required to traverse an obstacle such as a curb, the anti-tip assemblies 38 may be configured to have the second members 204 collapse or otherwise pivot clockwise about the joints 206 until the anti-tip wheels 208 are positioned substantially within the circumference of the drive wheels 22, as shown in FIGS. 3B and 3C. Preferably the anti-tip wheels 208 are positioned entirely within the circumference of the drive wheels 22 as shown in FIG. 3C. In operation, as the wheelchair 10 moves in a rearward direction, the anti-tip wheels 208 will contact the curb. As the wheelchair continues rearward the second members 204 and thus the anti-tip wheels 208 begin to pivot about the joints 206. Once fully collapsed the anti-tip wheels 208 will be within the circumference of the drive wheels 22 and the wheelchair 10 will be able to more easily traverse the curb.

Figure 4A:
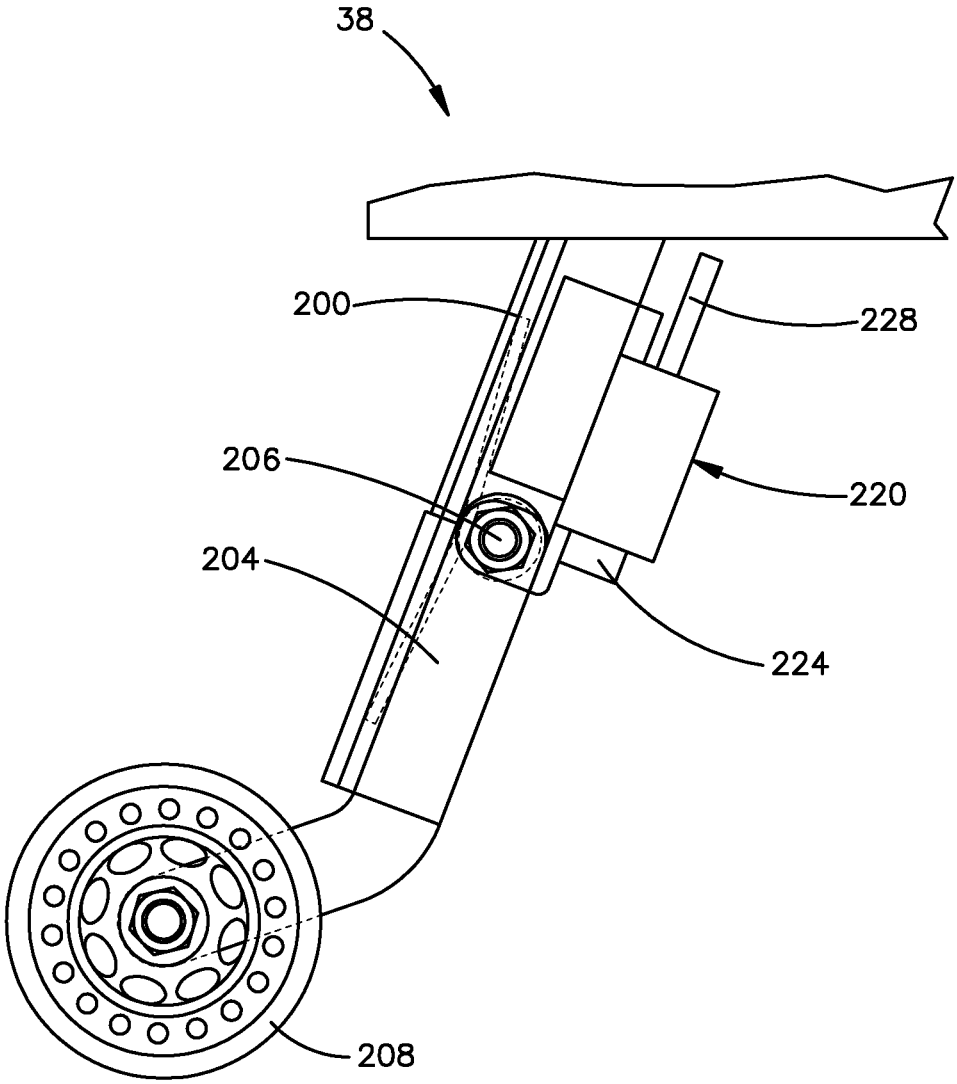
FIG. 4A is a detailed side elevation view of a rear anti-tip system in accordance with another embodiment, the anti-tip system including a lock mechanism.
Figure 4B:
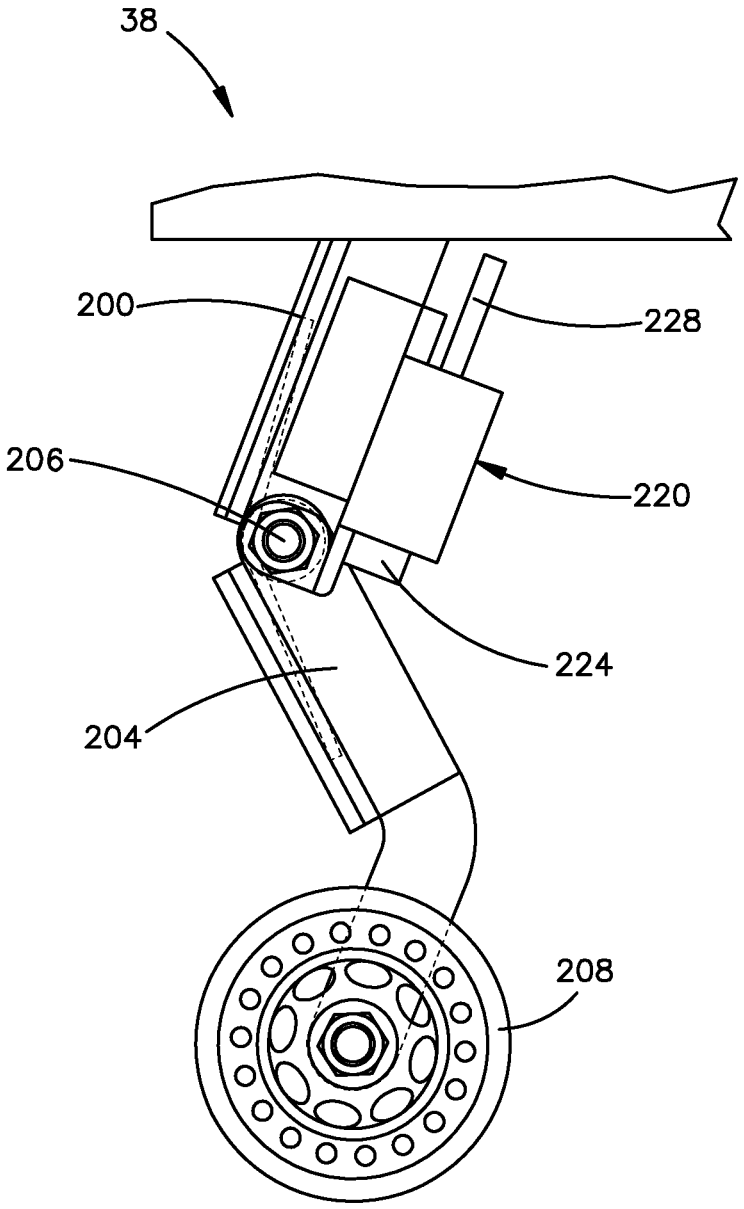
FIG. 4B is a detailed side elevation view of the rear anti-tip system shown in FIG. 4A in an unlocked and fully collapsed position.
Figure 4C:
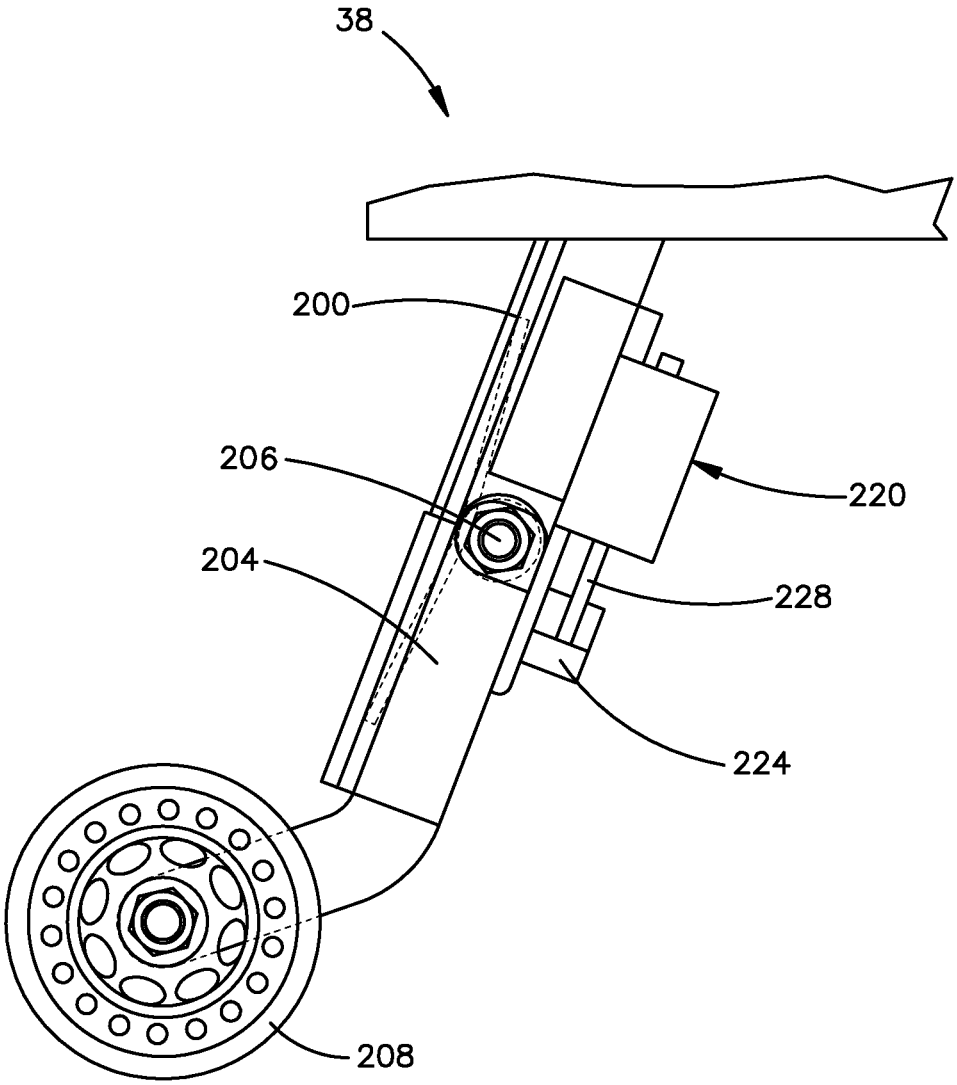
FIG. 4C is a detailed side elevation view of the rear anti-tip system shown in FIG. 4A in a locked and fully extended position.

In some circumstances it may be desirable to lock the anti-tip assemblies 38 such that the assemblies 38 are not capable of collapsing. For example, if the wheelchair is on an incline and facing up-hill, it may be desirable to lock the anti-tip assemblies 38 such that if the wheelchair 10 moves rearward down the hill and contacts a curb, the anti-tip assemblies 38 remain in their extended position. To lock the anti-tip assemblies, the anti-tip assemblies 38 may further include a locking mechanism 220 that is coupled to either the first member 200 or the second member 204. As shown in FIGS. 4A-4C, the locking mechanism 200 may include a solenoid having a retractable pin 228 and a sliding member 224 attached to the pin 228. As shown in FIGS. 4A and 4B, each locking mechanism 220 may have an unlocked position in which the pin 228 and thus the sliding member 224 are retracted. When retracted, the second members 208 are capable of pivoting about the joints 206. Alternatively, the locking mechanisms 220 may have a locked position in which the pins 228 are forced down to thereby move the sliding members 224 down such that the sliding members 224 at least partially extend over the joints 206 and the second members 204, as shown in FIG. 4C. Because the sliding members 224 extend over the joints 206 and the second members 204, the second members 204 will not be capable of pivoting about the pivot axis defined by the joints 206. Therefore, the anti-tip assemblies 38 will be locked in their extended positions. It should be understood, that the locking mechanisms 220 may include other configurations and are not limited to a solenoid and sliding member.

The lockable anti-tip assemblies 38 may include a sensor that indicates when the wheelchair 10 is on an incline. Such sensors may include but are not limited to ball angle sensors, and gyros. Such sensors may be configured to selectively lock the anti-tip assemblies 38 depending on the angle of the ground on which the wheelchair is moving.

Figure 5:
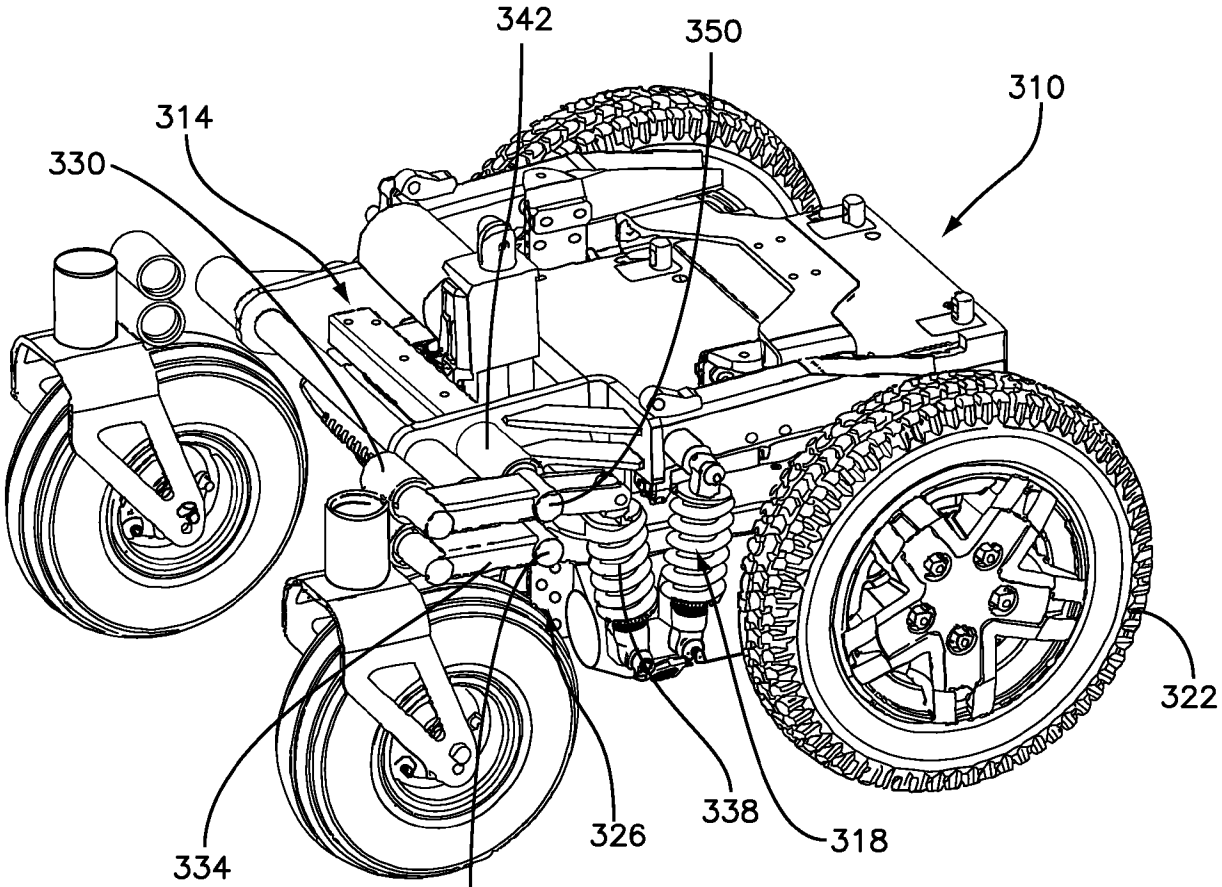
FIG. 5 is a side perspective view of a wheelchair in accordance with another embodiment.

Now referring to FIG. 5 the wheelchair may include a front-wheel suspension assembly in accordance with another embodiment. As shown, a wheelchair 310 includes a frame 314, a pair of drive-wheel suspension assemblies 318 that operatively coupled a pair of drive wheels 322 to the frame 314, and a pair of front-wheel suspension assemblies 326 that operatively couple a pair of caster assemblies 330 to the frame 314. The drive-wheel suspension assemblies 318 are substantially similar to the assemblies 18 of the embodiment shown in FIGS. 1A-1C unless otherwise described.

The front-wheel suspension assemblies 326, on the other hand, are slightly different than the assemblies 26 of the embodiment shown in FIGS. 1A-1C in that the caster arms are shorter and the spring has a substantially vertical orientation. In that regard, the suspension 326 includes a pair of caster arms 334 and a spring 338. As shown, the caster arms 334 are generally short substantially straight linkages that are vertically aligned one on top of the other. The linkages are rotatably coupled to respective barrels of the castor assemblies 330 and extend rearward toward respective barrels. As shown, the upper arms 334 extend rearward and are rotatably coupled to respective caster barrels 342 that are fixed to the frame 314. The lower arms 334, on the other hand, extend rearward and are rotatably coupled to respective caster barrels 346 that are fixed to the swing arms of the drive-wheel suspension assemblies 318.

Extending rearward of the upper arm 334 is a linkage 350 that is configured to couple to the spring 338. As shown, the spring 338 is attached to the motor at one end and attached to the linkage 350 at an opposed end. As shown, the spring 338 is substantially vertically oriented.

Like assembly 26, the front-wheel suspension assembly 326 allows the wheelchair 310 to traverse obstacles more easily in a forward direction. For example, by having two caster arms 334 for each assembly 326 that are rotatably coupled to both the caster assembly 330 and to the swing arm and frame 314, the caster arms 330 may be shorter in length while maintaining a high pivot for the assembly 326. The shorter arms allow for a more cost effective wheelchair. The high pivots, on the other hand, allow for all of the forces to go into forcing the assemblies 326, and thus the front wheels, up (i.e. clockwise) to thereby allow the wheelchair 310 to more easily traverse an obstacle as the wheelchair 310 moves in a forward direction.

Furthermore, like the assemblies 26, the configuration of the front-wheel suspension assemblies 326 help maintain the vertical caster barrels of the caster assemblies 330 in a substantially vertical orientation. By maintaining the vertical orientation, the front wheels will be able to swivel about the caster barrels more easily and not get jammed or otherwise impeded during turning of the wheelchair 310.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Further, several advantages have been described that flow from the structure and methods; the present invention is not limited to structure and methods that encompass any or all of these advantages. Those skilled in personal mobility technology, having the benefit of the teachings of this specification, may effect numerous modifications to the invention as described herein, and changes can be made without departing from the scope and spirit of the invention as defined by the appended claims. Furthermore, any features of one described embodiment can be applicable to the other embodiments described herein. For example, while the suspension assemblies and anti-tip assemblies have been described in relation to a rear-wheel drive wheel chair, it should be understood that the suspensions assemblies and anti-tip wheel assemblies may be used on other wheelchairs such as front-wheel drive wheelchairs.

What is claimed:

1. A wheelchair comprising:

a frame;

a pair of drive wheels operatively coupled to the frame;

a drive operatively coupled to each drive wheel; and a pair of anti-tip assemblies, each anti-tip assembly including a first member, a second member pivotally coupled to the first member at a joint that defines a pivot axis, an anti-tip wheel rotatably coupled to the second member, and a locking mechanism, wherein the second member is configured to pivot about the pivot axis from an extended position to a collapsed position whereby the second member rotates toward the first member, and the locking mechanism is configured to selectively lock the second member in the extended position, wherein the anti-tip wheel is positioned substantially within a circumference of the drive wheel when in the collapsed position.

2. The wheelchair of claim 1, wherein each locking mechanism includes a sliding member, and is configured to have a locked position in which the sliding member extends over the joint and prevents the second member from pivoting about the pivot axis, and an unlocked position in which the sliding member is retracted such that the second member is capable of pivoting about the pivot axis.

3. The wheelchair of claim 2, wherein the locking mechanism includes a solenoid coupled to the sliding member.

4. The wheelchair of claim 1, wherein at least one of the anti-tip assemblies includes a sensor that determines when to selectively lock the second member in the extended position.

5. The wheelchair of claim 1, wherein the anti-tip wheels are positioned entirely within the circumference of the drive wheels when the second members are in the collapsed position.

6. The wheelchair of claim 1, wherein each second member defines a foot that extends rearward, and the anti-tip wheels are rotatably coupled to the feet.

7. The wheelchair of claim 1, wherein each drive and drive wheel combination defines a respective drive-wheel assembly.

8. The wheelchair of claim 7, wherein the anti-tip assemblies are coupled to the drive wheel assemblies.

9. The wheelchair of claim 8, further comprising a pair of drive-wheel suspension assemblies that couple each drive wheel assembly to opposed sides of the frame.

10. The wheelchair of claim 9, wherein each drive-wheel suspension assembly includes a swing arm that is pivotally coupled to the frame.

11. The wheelchair of claim 10, wherein the drive wheel assemblies are capable of translating forward and rearward along the swing arms.

12. The wheelchair of claim 10, wherein each drive-wheel suspension assembly includes a spring that is coupled to both the frame and the drive wheel assembly.

13. A wheelchair comprising:

a frame;

a pair of drive wheels operatively coupled to the frame;

a drive operatively coupled to each drive wheel to thereby define respective drive-wheel assemblies; and a pair of anti-tip assemblies, each anti-tip assembly including a first member, a second member pivotally coupled to the first member at a joint that defines a pivot axis, an anti-tip wheel rotatably coupled to the second member, and a locking mechanism, wherein the locking mechanism includes a sliding member and is configured to have (i) a locked position whereby the sliding member extends over the joint and prevents the second member from pivoting about the pivot axis, and (ii) an unlocked position whereby the sliding member is retracted so as to not extend over the joint such that the second member is capable of pivoting about the pivot axis.

14. The wheelchair of claim 13, wherein the locking mechanism is configured to selectively lock each anti-tip assembly in the extended position.

15. The wheelchair of claim 14, wherein each anti-tip assembly is configured to have an extended position and a collapsed position, whereby the anti-tip wheel is positioned substantially within a circumference of the drive wheel when in the collapsed position.

16. The wheelchair of claim 13, wherein each anti-tip assembly is operatively coupled to a respective one of the drive wheel assemblies.

17. The wheelchair of claim 13, wherein the locking mechanism includes a solenoid coupled to the sliding member.

18. The wheelchair of claim 13, wherein at least one of the anti-tip assemblies includes a sensor that determines when to selectively lock the second member in the extended position.

19. The wheelchair of claim 16, further comprising a pair of drive-wheel suspension assemblies that couple each drive wheel assembly to opposed sides of the frame, wherein the drive wheel assemblies are capable of translating forward and rearward along the drive-wheel suspension assemblies.

20. A wheelchair comprising:

a frame;

a pair of drive wheels operatively coupled to the frame;

a drive operatively coupled to each drive wheel to thereby define respective drive-wheel assemblies; and a pair of anti-tip assemblies, each anti-tip assembly including a first member, a second member pivotally coupled to the first member at a joint that defines a pivot axis, an anti-tip wheel rotatably coupled to the second member, and a locking mechanism, wherein the second member is configured to pivot about the pivot axis between an extended position and a collapsed position, and the locking mechanism is configured to selectively lock the second member in the extended position, wherein the anti-tip wheel is positioned substantially within a circumference of the drive wheel when in the collapsed position.

21. The wheelchair of claim 19, wherein each anti-tip assembly is operatively coupled to a respective one of the drive wheel assemblies.

22. The wheelchair of claim 19, wherein at least one of the anti-tip assemblies includes a sensor that determines when to selectively lock the second member in the extended position.

23. The wheelchair of claim 19, further comprising a pair of drive-wheel suspension assemblies that couple each drive wheel assembly to opposed sides of the frame, wherein the drive wheel assemblies are capable of translating forward and rearward along the drive-wheel suspension assemblies.

* * * * *